US011491535B1

(12) United States Patent
Watts et al.

(10) Patent No.: US 11,491,535 B1
(45) Date of Patent: Nov. 8, 2022

(54) METHOD AND APPARATUS FOR ESTIMATING DIMENSIONAL UNIFORMITY OF CAST OBJECT

(71) Applicant: United States Pipe and Foundry, LLC, Birmingham, AL (US)

(72) Inventors: Kenneth J Watts, Alpine, AL (US); Stephanie R Holtz, Baltimore, MD (US)

(73) Assignee: United States Pipe and Foundry Company, LLC, Birmingham, AL (US)

( * ) Notice: Subject to any disclaimer, the term of this patent is extended or adjusted under 35 U.S.C. 154(b) by 0 days.

(21) Appl. No.: 17/373,145

(22) Filed: Jul. 12, 2021

(51) Int. Cl.
*B22D 13/12* (2006.01)
*B22D 13/02* (2006.01)

(52) U.S. Cl.
CPC ..... *B22D 13/12* (2013.01); *B22D 13/023* (2013.01)

(58) Field of Classification Search
CPC ..... B22D 13/02; B22D 13/023; B22D 13/12
USPC ..... 164/114, 117, 286, 4.1, 457
See application file for complete search history.

(56) References Cited

U.S. PATENT DOCUMENTS

| | | | |
|---|---|---|---|
| 2,763,041 | A | 9/1956 | Doat |
| 2,832,108 | A | 4/1958 | Vossberg |
| 2,943,369 | A | 7/1960 | Szwed |
| 3,056,179 | A | 7/1960 | Lorang |
| 4,036,279 | A | 7/1977 | Nieman |
| 4,316,495 | A | 2/1982 | Pierrel |
| 4,370,719 | A | 1/1983 | Upchurch et al. |
| 4,796,688 | A | 1/1989 | Gundlach et al. |
| 5,762,728 | A | 6/1998 | Kuramasu et al. |
| 7,770,628 | B2 | 8/2010 | Simpson et al. |
| 8,186,421 | B1 | 5/2012 | Carter et al. |
| 8,327,912 | B2 | 12/2012 | Terada et al. |
| 8,733,424 | B1 | 5/2014 | Watts et al. |
| 8,910,699 | B2 | 12/2014 | Watts et al. |
| 2004/0182538 | A1 | 9/2004 | Lambrecht |
| 2008/0023172 | A1 | 1/2008 | Waugh |
| 2009/0308562 | A1 | 12/2009 | Rauguth et al. |
| 2012/0048429 | A1 | 3/2012 | Waugh |

OTHER PUBLICATIONS

Nolen, L.A. "Transactions of the American Foundrymen's Society—Proceedings of the Seventy-Fourth Annual Meeting"; Apr. 6 to Apr. 10, 1970; vol. 78; pp. 1-3 and 269-272 Apr. 10, 1970.

SAS/STAT(R) 9.2 User's Guide, Second Edition, u http:/ /su ppo rt.sas .co m/docu me ntatio n/cd l/ e n/statug/63033/HTM Udefau lt/viewer. htm#statug_i ntro reg_ sect003. htm. Copyright Sep. 2009.

Multivariable Methods. http://sphweb.bumc.bu.edu/otlt/MPH-Modules/BS/BS704_Multivariable/BS704_Multivariable7.html. Last Modified Jan. 17, 2013.

*Primary Examiner* — Kevin P Kerns
(74) *Attorney, Agent, or Firm* — Paul Sykes; Bradley Arant Boult Cummings LLP

(57) ABSTRACT

A method and apparatus for providing an estimate of uniformity of wall thickness of a centrifugally cast object, such as a pipe cast from molten iron, substantially immediately after the casting process is complete. The volume of molten metal entering the mold over time is determined and correlated with casting machine position and velocity data to estimate wall thickness along the length of the pipe. Process defects can then be identified promptly and corrective action taken.

10 Claims, 10 Drawing Sheets

METHOD AND APPARATUS FOR ESTIMATING DIMENSIONAL UNIFORMITY OF CAST OBJECT

TECHNICAL FIELD

The invention relates generally to the field of centrifugally casting metal objects, and more specifically, to the field of centrifugally casting of iron pipe.

BACKGROUND

The process of centrifugal casting of metal objects, and in particular of iron pipe, is well known and has been practiced for a century. A centrifugal casting machine includes a delivery system, such as a trough, and a rotating mold. Molten iron is poured from a machine ladle into the trough. The trough extends into the interior of the rotating mold, generally axially. One end of the mold usually includes a core, such as a sand core, to accurately shape what is called the bell of the pipe. The opposite end of the pipe is referred to as the spigot, and the elongated section in between is the barrel. The molten iron flows down the trough under the influence of gravity. The mold and trough are moved relative to one another to fill the mold with iron, typically from the bell end along the barrel to the spigot. As the mold rotates, centrifugal force disposes the iron circumferentially around the mold in a relatively even manner. Typically, the casting machine is moved via hydraulics or other mechanical means, as is known in the art, to dispose the iron as desired.

Variation in the charge mix (i.e., the source of raw material for the foundry, such as scrap iron), coke, and cupola operation results in variation in the molten iron temperature and chemical composition. The variation in content of the molten iron also manifests itself in the liquidus arrest temperature and the fluidity of the molten iron, which in turn causes variations in frictional forces, surface tension, heat diffusivity, of the molten iron from which each pipe is cast, which themselves may vary from one pour to the next based on pour temperature. All of this results in inconsistency in the flow rate of iron to the mold. The variation in molten iron content cannot be cost effectively eliminated in a facility using material from recycled or scrap sources.

The casting process can be thought of as governed by two operations, which occur roughly contemporaneously but are controlled independently of one another. One operation tilts the machine ladle to pour the iron, and the other moves the mold relative to the trough to allow distribution of the iron in the mold. The overall volume of molten iron poured for casting, and therefore the weight of the pipe, is determined by the operation of the ladle. The distribution of the iron within the mold is determined primarily by movement of the mold and secondarily by ladle operation. The applicant hereof has obtained U.S. Pat. Nos. 8,733,424; 8,910,669; 8,960,263, which are directed towards the controlling movement of the mold relative to the trough. These patents disclose an apparatus and method to control casting machine parameters and movement to account for changing fluidity of the molten iron due to variability in the charge mix and pour temperatures.

As to operation of the machine ladle operation, controls for parameters associated with tilting the machine ladle include machine ladle pouring rate, machine ladle cutback position, and spigot check position. For example, the machine ladle pouring rate sets the flow rate for the molten iron being poured from the ladle. When molten iron is poured from the machine ladle during the casting cycle, there is a delay while the iron (typically under the force of gravity) traverses a trough that terminates in a spout, from which the iron is disposed in the mold. The delay varies based on the size and length of the trough, flow rate, and other factors, but its duration is significant relative to the overall duration of the casting cycle. For example, in a process where the actual casting time is 15 seconds, the delay from pouring the iron from the ladle to its leaving the spout of the trough may be 4 seconds. This delay therefore makes any changes to controls associated with the machine ladle difficult to make "on the fly."

Machine ladles are designed to be linear pour devices so that equal degrees of rotation of the ladle will deliver equal volumes of molten iron. Over time, however, the ladle may become non-linear in its pouring characteristics. Non-linearity in ladle pouring may be introduced by variations in the dimensions of the ladle. Slag, a viscous ceramic substance that is dissolved in molten iron, may come out of solution and deposit in the ladle. It may deposit in various locations in the ladle and cause non-linear pouring in a number of modes. Changes in pour linearity are subtle and are compounded over time. This can cause a decrease in volumetric flow rate of iron even though the ladle pour rate control (degree of tilt of the machine ladle) has not been changed at all.

One mode of non-linearity in pouring is from slag build-up in the ladle lip area. This may cause decreased volume of molten iron at the beginning of the casting cycle. The initial low volume flow would cause bell wall thickness to be less than anticipated. This can be offset by increasing the pour rate, which will also increase the pipe weight and thickness of the pipe wall throughout its length. Casting machine (mold) movement also can be adjusted to restore pipe wall uniformity.

Another mode of non-linear variation in pouring is from slag build-up in the teapot area of the ladle. This may cause decreased volume of molten iron at the end of the cast cycle. Insufficient volume of molten iron at the end of the cast cycle would cause the pipe wall to be thin at the spigot. The spigot wall thickness may be increased by changing the ladle cutback position control, which will allow the ladle to pour for a longer period of time. The longer pour time will increase the volume of molten iron to the spigot end of the pipe, increasing its thickness there.

Non-linear variation in pouring may be generated by erosion of the ceramic ladle lining material. This erosion may cause the ladle to change dimension in any area. As the non-linearity increases, the pipe wall thickness uniformity may vary in a number of ways. Often the only remedy for pipe wall thickness that is not sufficiently uniform is to replace the machine ladle.

In sum, with variability introduced by chemical content of molten iron, changes in pour temperature, and changes in linearity of ladle pouring characteristics, uniformity of results and adherence to specifications can be difficult to achieve even with hydraulic systems controlled by programmable logic controllers (PLCs). The casting operator simply cannot detect changes in the iron or pour characteristic that affect wall thickness uniformity in a timely manner in order to adjust the casting machine controls. Instead, until now when an iron pipe is cast in a centrifugal casting machine, no feedback for its wall thickness uniformity is available for the casting machine operator for hours after casting, because the pipe typically must complete annealing and processing (a period of hours) before it can be measured, usually with an ultrasonic thickness instrument.

Although casting apparatus may operate at different speeds, in one example, the pipe is cast at a rate of 0.75 seconds per foot. Therefore, a 20-foot length of pipe may require only 15 seconds to cast. It will be apparent that hundreds of pipe may be cast before the first pipe has been annealed and sufficiently cooled for the ultrasonic measurement of wall thickness. Further, when one of the casting parameters is altered in an attempt to correct the error, it will require several more hours before it can be determined if the alteration has resulted in the desired correction or has increased variation in pipe wall thickness.

Thus, there is a need for an apparatus and method that provides an accurate estimate of uniformity of pipe wall thickness proximate to completeness of the casting process.

SUMMARY

Embodiments of the present invention satisfy these needs, but it should be understood that not all embodiments satisfy each need. One embodiment comprises a method of estimating wall thickness of an object formed in centrifugal casting process in which molten metal is poured in a stream from a ladle into a casting machine having a trough that is movable linearly with respect to a longitudinal axis of a rotating cylindrical mold. In this embodiment, a volume of molten metal associated with a sample of the stream poured from the ladle is determined and correlated to a longitudinal position on the mold. Images of the molten stream as poured from the ladle are captured by a machine vision device, and the cross sectional area of each sample is determined. The overall volume of the object is determined from its weight immediately after casting and the density of the material from which it was cast. This volume is divided by the sum of the areas of each sample to determine the length of the stream. Multiplying this length with the area of one sample yields the volume of molten iron associated with that sample. The volume for each sample is determined in this way and correlated to its position on the mold. The correlation is based on position data obtained from a controller controlling and recording the movement of the casting machine. Using the incremental volumes and their associated positional data, wall thickness over the length of the object may then be calculated and displayed.

In another embodiment, the diameter of the stream samples or their volumes may be correlated with velocity of the casting machine over time and displayed. The relationship between these variables is indicative of uniformity of wall thickness.

Another embodiment of the present invention comprises an apparatus for determining an estimate of uniformity wall thickness of an object centrifugally cast by from molten metal poured from a ladle into a trough that is positioned relative to a rotating mold for disposing the molten metal from the trough into the mold. In this embodiment, the apparatus includes an image capture device positioned to capture an image of a stream of molten metal poured from the ladle, a drive system coupled to at least one of the trough or mold, a controller for controlling the drive system and receiving data indicative of movement of the trough relative to the mold; and a processor programmed to use image data from the image capture device to correlate over time a volume of molten metal poured from the ladle with position data of the mold for where that volume was cast and determine an estimate of wall thickness uniformity from the correlation. In a preferred embodiment, the apparatus includes a graphical display in operative communication with the processor, where the processor is further programmed to provide an indicator of uniformity on the display. The apparatus may also include a sensor positioned to detect when molten metal exits the trough, where the sensor is in operative communication with the processor.)

BRIEF DESCRIPTION OF THE DRAWINGS

The present invention will be explained, by way of example only, with reference to certain embodiments and the attached figures, in which:

FIG. 8 is an exemplary graph plotting casting machine velocity versus iron stream cross sectional area, according to an embodiment of a method of the present invention; and.

DETAILED DESCRIPTION

This disclosure will describe certain embodiments of the invention with respect to an exemplary application of centrifugal casting of iron pipe specified to have uniform diameter with a constant wall thickness. Embodiments of the present invention may be readily applied to produce pipe of varying (tapering) diameter or cross-sectional profiles (e.g., hexagonal), with varying wall thickness along the length of the pipe. It should be also understood that embodiments of the present invention may be practiced with respect to the centrifugal casting of any object from molten metal of other alloys, by using known metallurgical relationships for such alloys in place of such relationships as described in this disclosure with respect to iron. Further, a reference to iron should be understood as a reference to an alloy of iron, typically comprising quantities of carbon, silicon, and phosphorous, but which also may comprise quantities of other elements or compounds that may affect its properties. Embodiments of the method and apparatus of the present invention are ideally suited to casting objects within a desired tolerance from iron or other molten metal having varying or unknown composition from batch to batch in the casting process.

Figure 1:
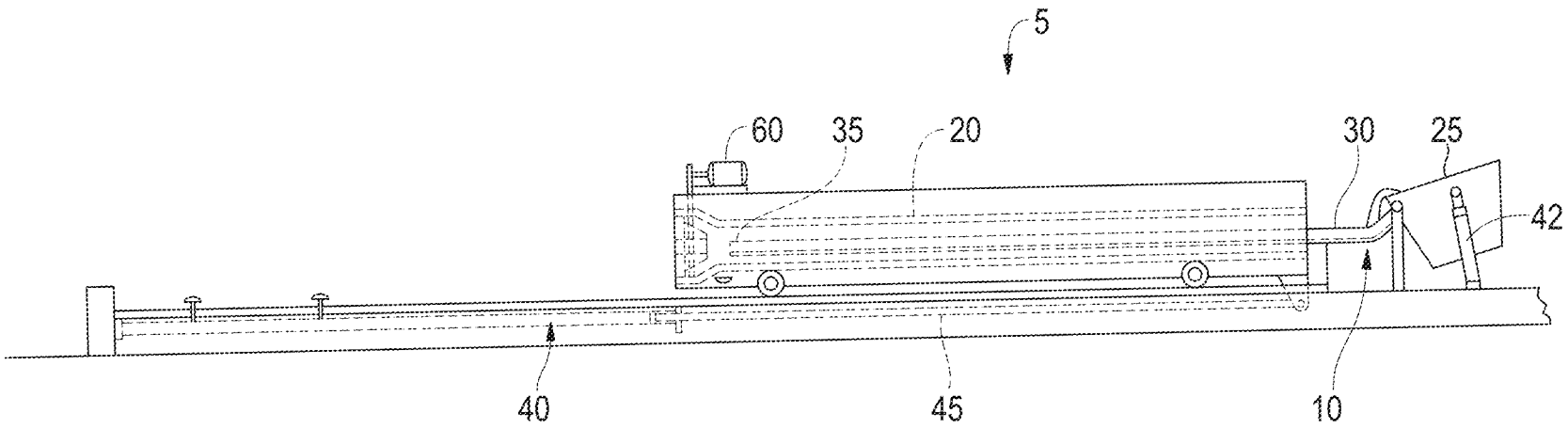
FIG. 1 is an exemplary embodiment of a casting machine, which forms part of an embodiment of an apparatus of the present invention.
Figure 4:
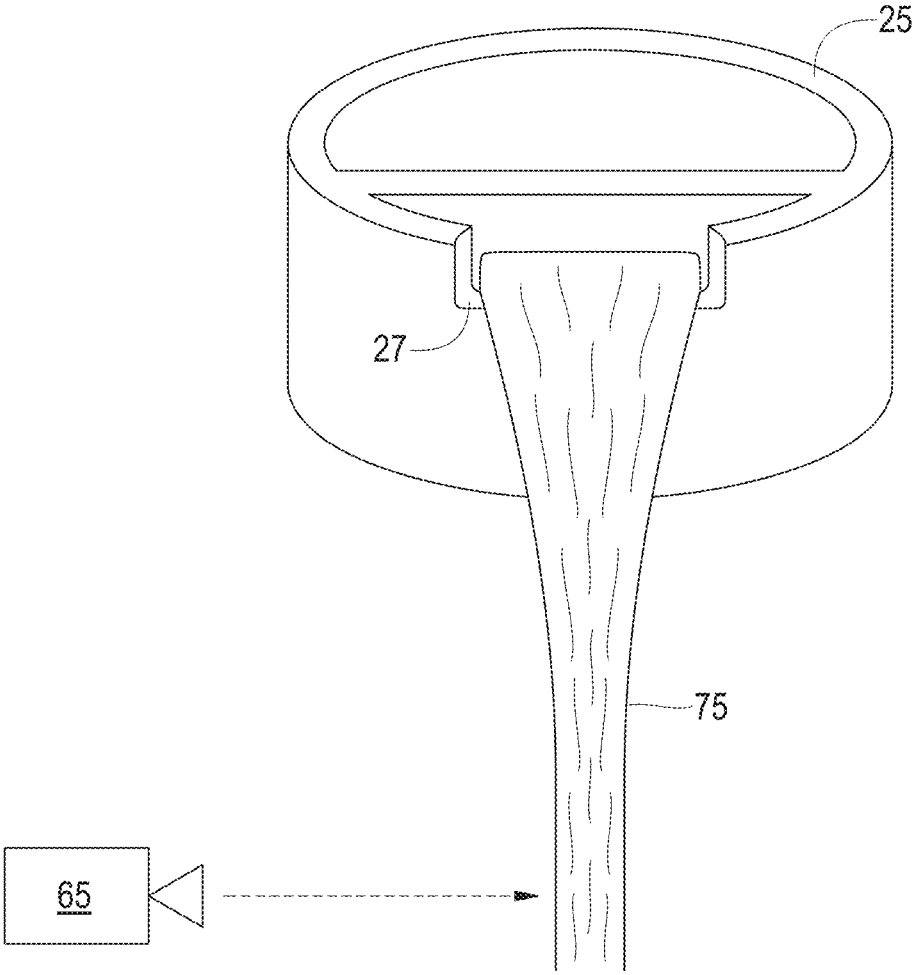
FIG. 4 is diagram of an exemplary arrangement of the camera and ladle of the embodiment of FIG. 3.

FIG. 1 illustrates part of an exemplary embodiment of an apparatus of the present invention. As shown in FIG. 1, a casting machine 5 is a typical centrifugal casting machine as is known in the art, which comprises a conveying system 10 to transport a quantity of molten iron into a mold 20, which is rotated by a motor 60 during the casting process. In a preferred embodiment, the conveying system 10 comprises a machine ladle or other container 25 that contains the molten iron and a U-shaped trough 30. The machine ladle 25 preferably dispenses a constant volume of iron per degree of rotation. It should be noted, however, that embodiments of the present invention can be used with any type of ladle or dispensation container, so long as it provides a consistent pour profile from one pour to the next. The terms "ladle" or "machine ladle" are synonymous and shall refer to any container used for dispensation of molten metal for casting. The trough 30 is angled slightly downward and extends axially into the interior of the mold 20, terminating at a spout 35. When the machine ladle 25 is tilted, molten iron flows in a stream 75 from the lip 27 of the ladle 25 (as shown in FIG. 4), down the trough 30, out the spout 35 and into the mold 20 under the influence of gravity. The mold 20 is mounted to a drive system 40.

The drive system 40 comprises actuators 45 to move the mold back and forth within a fixed range of motion with respect to the fixed end (i.e., spout 35) of the conveying system 10. The actuators 45 may be any type of actuator known in the art to move the mold 20, including hydraulics, electrical motors, a belt or chain-drive mechanical linkage to an engine or motor, any combination thereof, or other means known in the art for moving a mold. In some embodiments, the conveying system 10 is moved longitudinally by a drive system 40 with respect to the mold 20, which remains fixed in position. In this disclosure, the terms casting machine velocity or casting machine movement refer to movement (or the rate thereof) of the mold 20 relative to the trough 30 as driven by drive system 40, and may describe an apparatus in which either or both components move relative to the other.

Similarly, the machine ladle 25 is coupled to a tilt system 42, which includes actuators of any type known in the art, including hydraulics, electrical motors, a screw drive, a belt or chain-drive mechanical linkage to an engine or motor, any combination thereof, or other means known in the art, to controllably rotate or tilt the machine ladle to or from any desired degree, or otherwise to cause a stream 75 of molten iron to pour from its lip 27 (as shown in FIG. 4) at a predetermined pouring rate (typically uniform per degree of tilt), and to return the machine ladle from the pouring position to its initial upright or pouring position.

Figure 3:
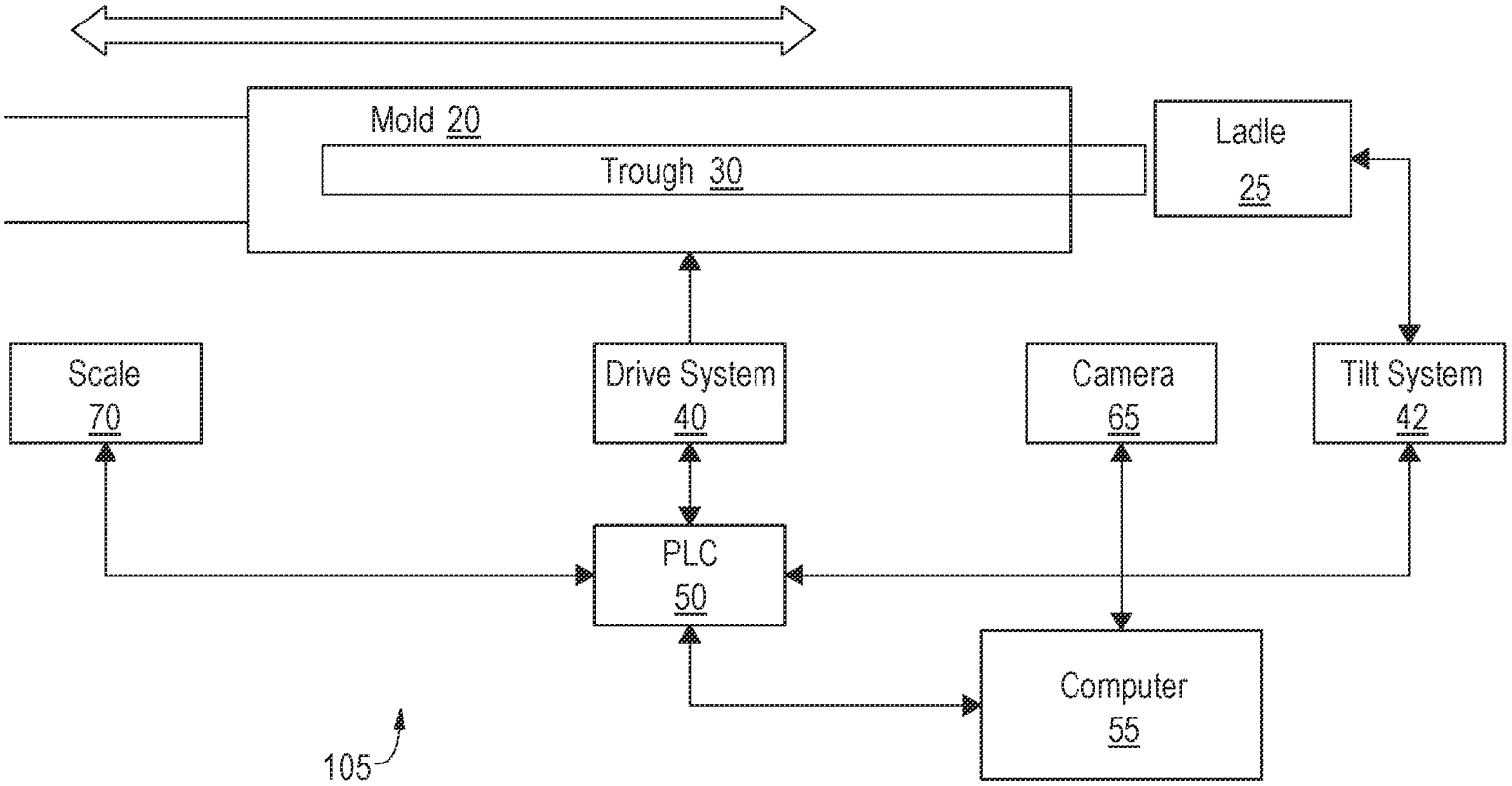
FIG. 3 is a block diagram of an embodiment of the apparatus of the present invention.

As shown in the embodiment of FIG. 3, each of the drive system 40 and the tilt system 42 is preferably controlled by a programmable logic controller (PLC) 50 in operative communication with a computer 55 for the transfer of commands and data between them. Computer 55 is used broadly here to refer to any computational system capable of receiving, directly or indirectly, and processing the data and performing the calculations and other steps of the methods described herein, and would include a local standalone general purpose computer programmed with appropriate software, such a general purpose computer in communication with a server over a network dividing tasks or storage between them, a cloud-based processor remote from the casting site and receiving the appropriate data over a communications network, a mobile or handheld device, an application specific computing device, or any combination of the foregoing. The PLC 50 controls and encodes the casting machine movement over time, including position, velocity, and acceleration. Data provided from the PLC 50 to the computer 55 may include positional data of the mold 20 relative to the trough 30 over time, the velocity of the mold 20 relative to the trough 30, and the extent or degree of tilt of the machine ladle 25 over time.

Hence, in an exemplary process, the machine ladle 25 is tilted to a predetermined extent for a predetermined duration to deliver molten iron to the rotating mold 20 via the conveying system 10. The tilt of the machine ladle 25 is reversed, typically in a single continuous movement, to return it to its initial or resting position, in which no molten iron is poured. The mold 20 is moved with respect to the conveying system 10 such that molten iron is disposed along the length of the mold in a volume intended to provide a cast object (as illustrated, a pipe) having predetermined specifications, including for example, wall thickness.

Figure 5:
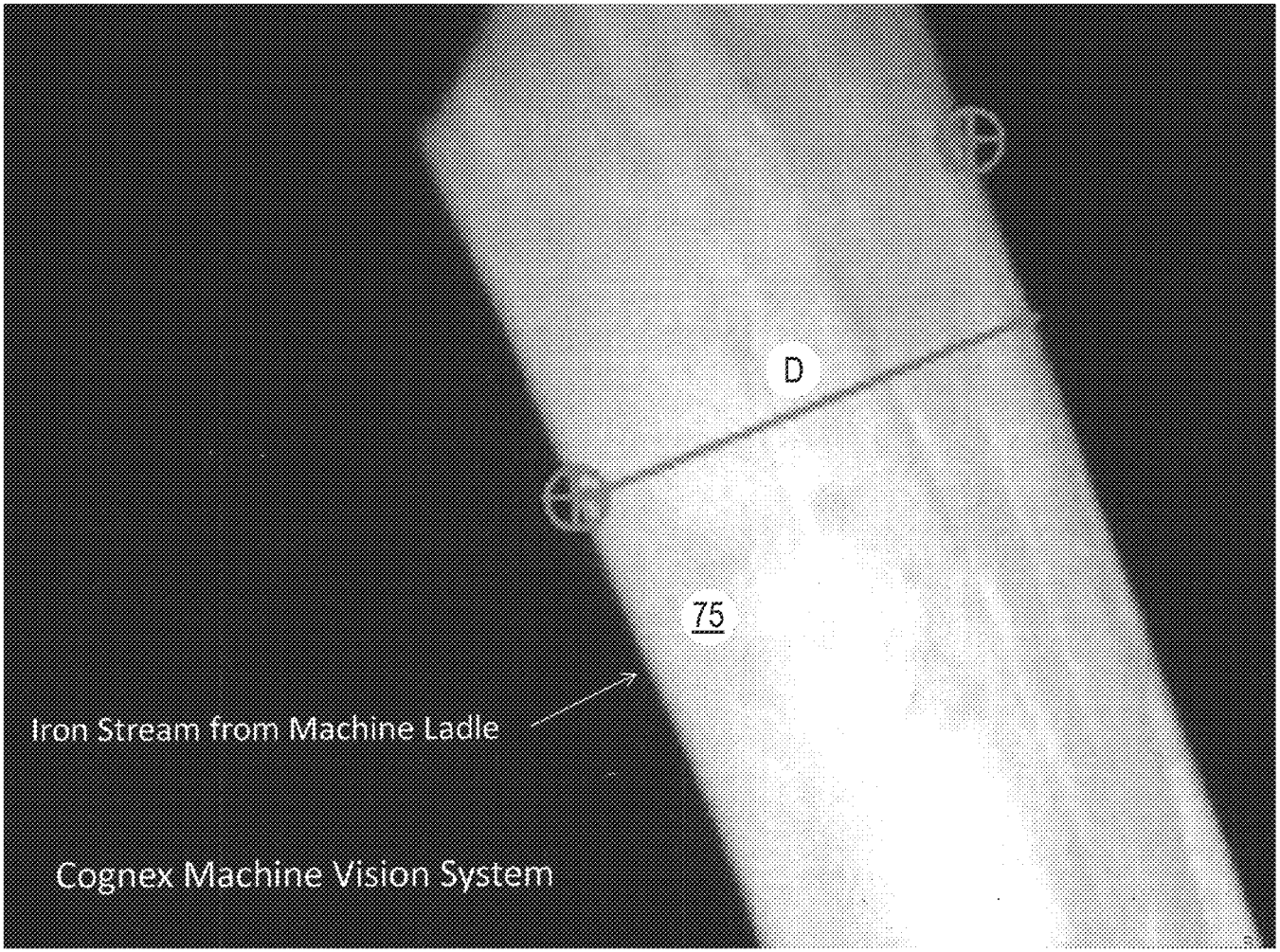
FIG. 5 is an exemplary image of a stream of molten iron captured by a machine vision system, such as the camera of FIG. 4.

The embodiment 105 further comprises an instrument for measuring the volume of the stream 75 of molten iron poured from the machine ladle 25. In a preferred embodiment, this instrument is a machine vision device, such as an image capture device referred to herein as camera 65, positioned as shown in FIG. 4 to capture data representative of images of the iron stream 75 after it exits the lip 27 of the machine ladle 25 and before it reaches the trough 30. In a still preferred embodiment, the camera 65 may be a Cognex Model 821-10020-IR machine vision system. The camera 65 is configured to capture a series of images of the stream 75 at predetermined intervals of time and provide these images (or more specifically, data representative of them) to the computer 55. An exemplary image of an iron stream as captured by the camera 65 is shown in FIG. 5. The computer 55 includes software, for example Cognex In-Sight Explorer (provided with its machine vision system), that obtains a diameter of the iron stream from an image captured by the camera 65, as shown in FIG. 5. Alternative embodiments may, for example, provide a continuous or near continuous video feed at a desired frame rate (such as 32 frames/second) to the computer 55, which executes image processing software to compute the volume of the iron stream continuously or at any desired time interval or point in time from the video, such as by determining the diameter or cross sectional area of the stream.

Figure 2:
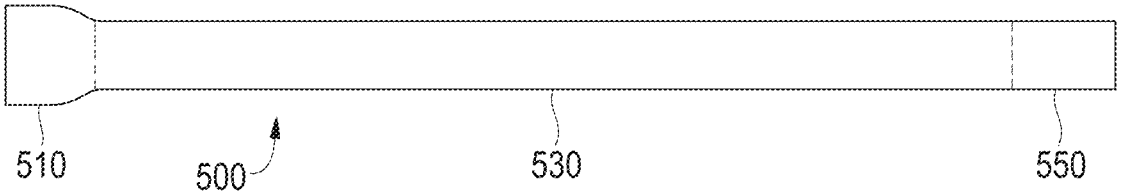
FIG. 2 is an example of a pipe cast from the embodiment of FIG. 1.
Figure 6A:
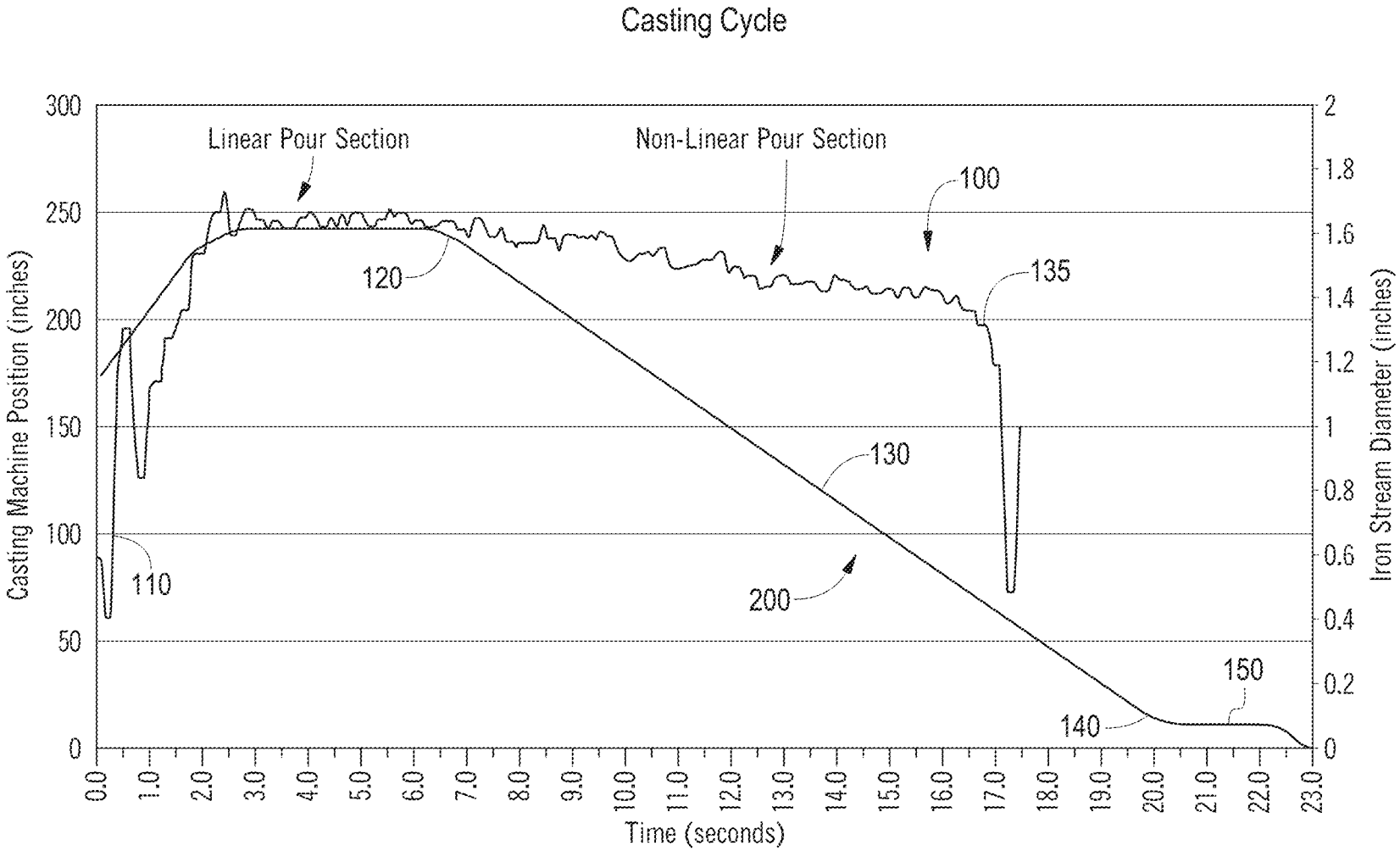
FIGS. 6A-6C are exemplary graphs plotting molten iron volume and casting machine position (FIGS. 6A-6B) or casting machine velocity (FIG. 6C) over time.
Figure 6B:
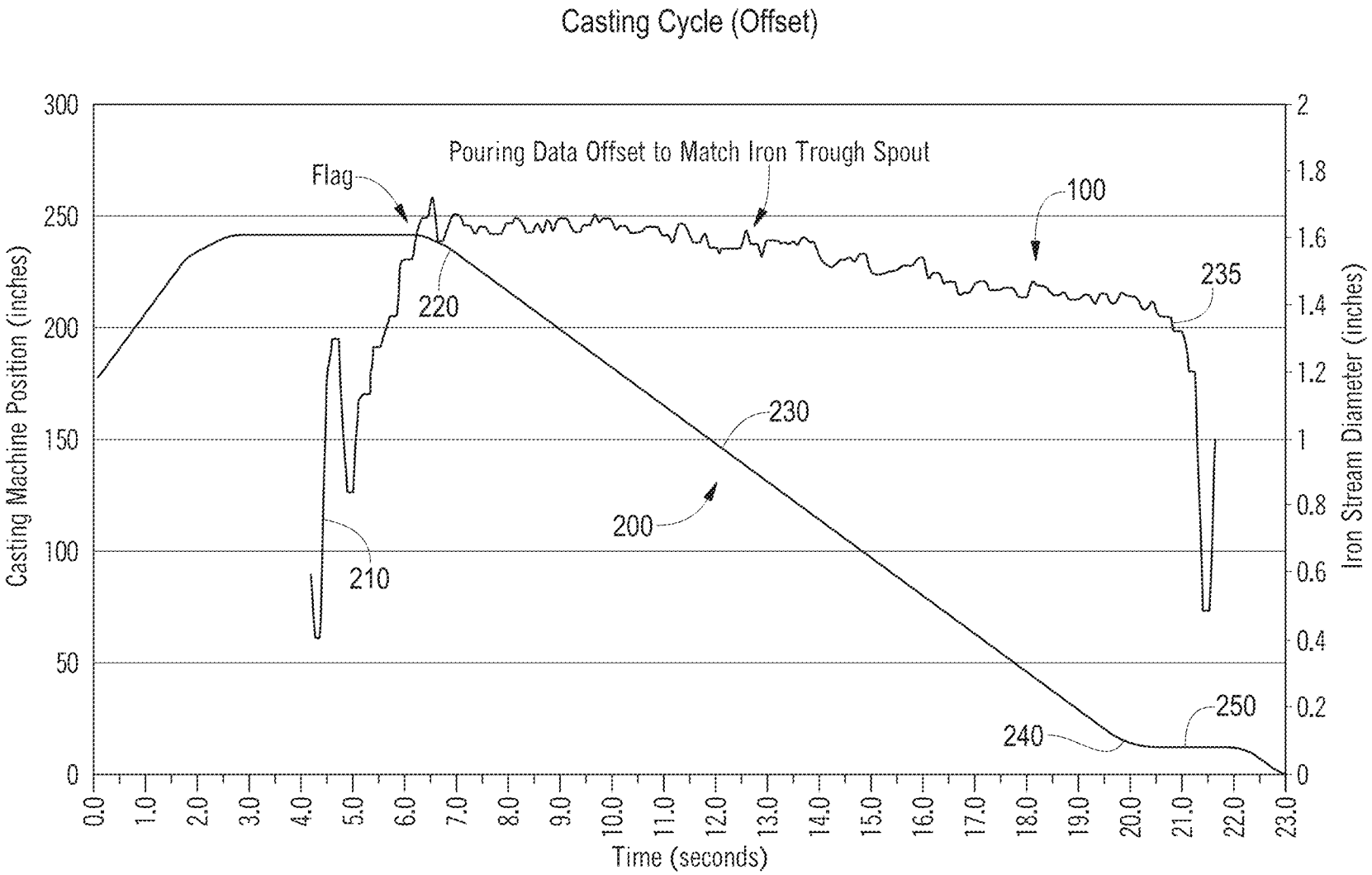
Figure 6C:
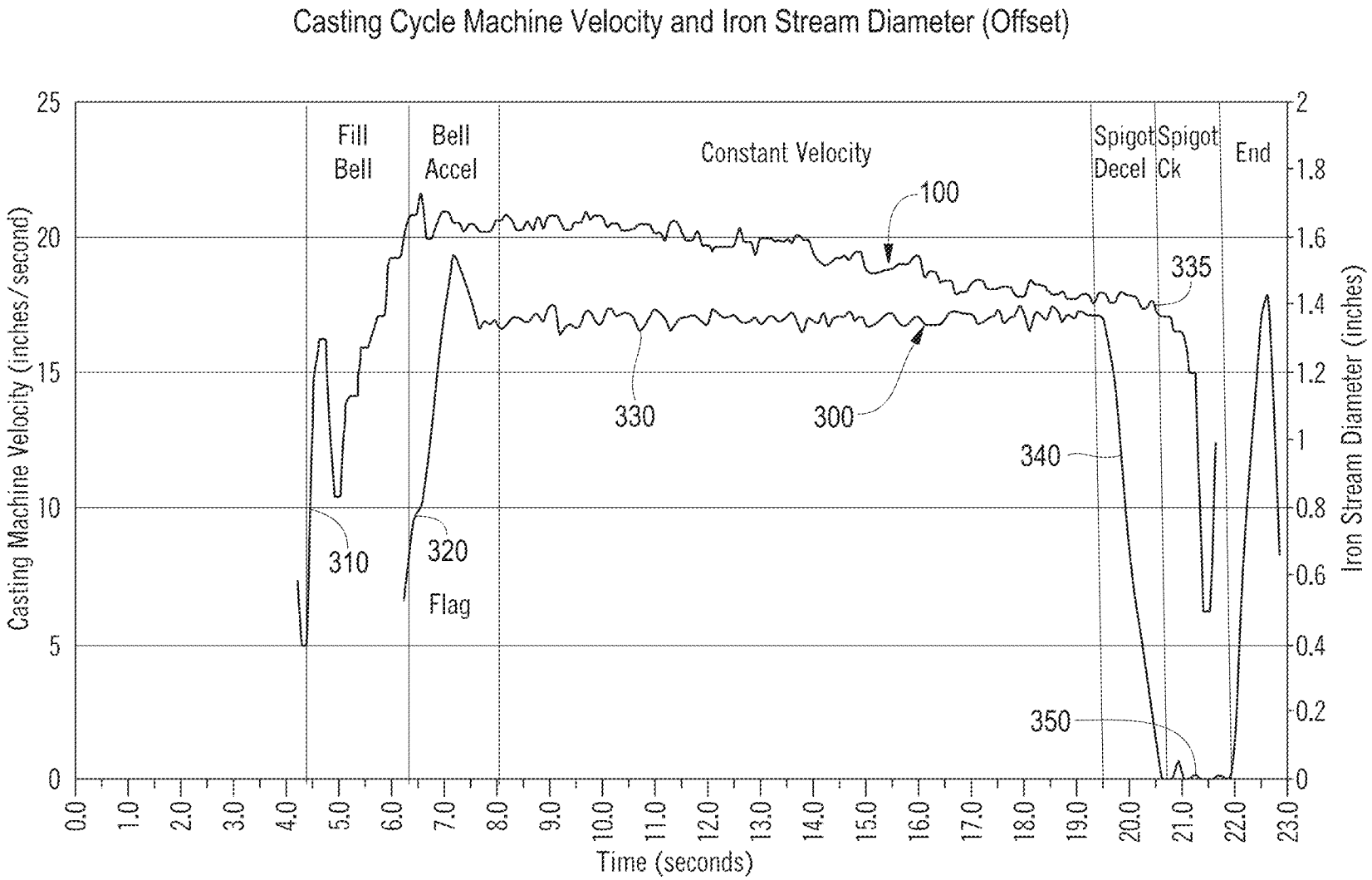

FIG. 2 shows an exemplary iron pipe 500, a typical profile in the industry, cast by a centrifugal casting machine such as shown in FIG. 1. For such a pipe, the casting process can be divided into five main steps. Data indicative of these steps is illustrated in FIGS. 6A-6C. Specifically, FIG. 6A reflects the operation of the machine ladle 25 as shown by the pour curve 100, which plots the diameter of the iron stream 75 poured from the machine ladle 25 as captured by the camera 65 over time, and the operation of the casting machine 5 as shown by position curve 200, which plots the position of the spout 35 from the bell end of the mold 20 over the same time axis. As noted above, there is a time delay from when molten iron is poured from the machine ladle 25 to when it enters the mold 20. In FIG. 6B, the pour curve 100 has been offset on the time axis by this delay; FIG. 6B therefore correlates the volume of iron entering the mold 20 with the position of the mold at that time. In FIG. 6C the velocity of the casting machine shown by curve 300 and the pour curve 100 are plotted over time, again with the pour curve 100 offset by the delay between the molten iron leaving the machine ladle 25 and entering the mold 20.

First, the machine ladle 25 is tilted to a predetermined position to obtain a desired pour flow rate. The mold 20 is brought into position with the spout 35 of trough 30 in the bell portion of the mold. For efficiency in process time, this may be done as the iron stream begins pouring from the machine ladle 25 and travels down the trough. Preferably, a sensor such as a photoelectric sensor detects when molten iron exits the spout 35 of the trough 30. As the molten iron exits the spout 35 of the trough 30, the mold 20 remains stationary until the bell of the pipe mold is nearly filled, as shown in the portions of the curves labeled 110, 210, and 310, respectively, on FIGS. 6A-6C. This time period is referred to as the flag delay time. In this exemplary process, as known in the art, a sand core having dimensions in accordance with a desired pipe specification is held in place at the end of the mold by a core setter, which is a mechanical arm attached the casting machine. (The core setter may also serve as a mount for the sensor that detects molten iron exiting the spout 35 of the trough 30.) The bell of the pipe is cast in a precisely defined cavity formed between the sand core and the pipe mold. For a given sand core specification, the cavity defining the bell has a predetermined and constant volume from one casting cycle to the next. Therefore the bell weight is likewise constant and referred to as the standard bell weight. During this phase, as shown by the pour curve 100, the volume of molten iron increases as the stream of molten iron first exits the ladle until it reaches a more constant volume.

Next, at the point labeled "flag," the casting machine enters the bell acceleration phase labeled 120, 220, and 320, respectively, and accelerates to a constant velocity. Next, with the iron stream having reached a near constant volume, the casting machine moves the mold at a near constant velocity during phase labeled 130, 230, and 330, such that molten iron is disposed substantially evenly along the length of the mold corresponding to the barrel of the pipe. Towards the end of this phase, as shown near the point 135, 235, 335, the machine ladle is tilted back, which is usually referred to as "the machine ladle cutback position," and the diameter of the iron stream (and its resultant volume) quickly diminish; however, molten iron continues to flow out of the trough 30 into the mold 20. As the machine approaches the end of the barrel, referred to as the spigot, the machine decelerates in the spigot deceleration phase 140, 240, and 340, to a stop. This corresponds to the filling of a portion of the barrel near the spigot end of the pipe. Finally, during the spigot check phase labeled as 150, 250, and 350, a delay transpires corresponding to the time at which the casting machine is stopped near the end of the mold 20 until molten metal ceases to pour from the spout 35 of the trough 30 into the mold 20. This time period, 150, 250, 350, is referred to as the spigot check time or dwell time. The casting machine then moves to the end point of the mold.

The actual iron delivery flow curve for a given pour of molten iron, especially sourced from recycled materials, is difficult to predict and varies from batch to batch of molten iron. As a result, casting an object within close tolerances of a given set of specifications can be difficult. In one embodiment, the object to be cast is a pipe of uniform wall thickness through its barrel and spigot. Wall thickness is a function of iron delivery to the mold, and therefore the volume of iron delivered per unit distance should be constant over the length of the mold to provide pipe of uniform wall thickness. The uniformity wall thickness (or other desired specification) can be controlled by the movement of the conveying system 10 relative to the mold 20 according to a transfer function that accurately relates the required acceleration, deceleration, and velocity of the relative motion of the casting machine 5 to the volumetric delivery requirements of the mold 20 to achieve the desired specifications. This is described in the patents referenced above owned by the applicant. Wall thickness also is affected by the pour rate from the machine ladle, flag delay time, the machine ladle cutback position, and the spigot check or dwell time, all of which may be influenced by non-linearities in pouring.

In an embodiment of the method of the present invention, data corresponding to the position of the casting machine overtime (and hence its velocity) and the volume of the iron stream 75 are recorded. In the embodiment of the apparatus described above, data representative of the casting machine over time is captured by the PLC 50 (which also controls its movement), and of the iron stream is recorded by the camera 65. In this embodiment, software in the computer 55 extracts the diameter of the iron stream from image data captured by the camera and reports it upon predetermined intervals, for example, every 0.1 seconds. Further, upon completion of the casting of the object (such as the exemplary iron pipe), the object is ejected from the mold and its weight is captured by a scale 70.

Figure 9:
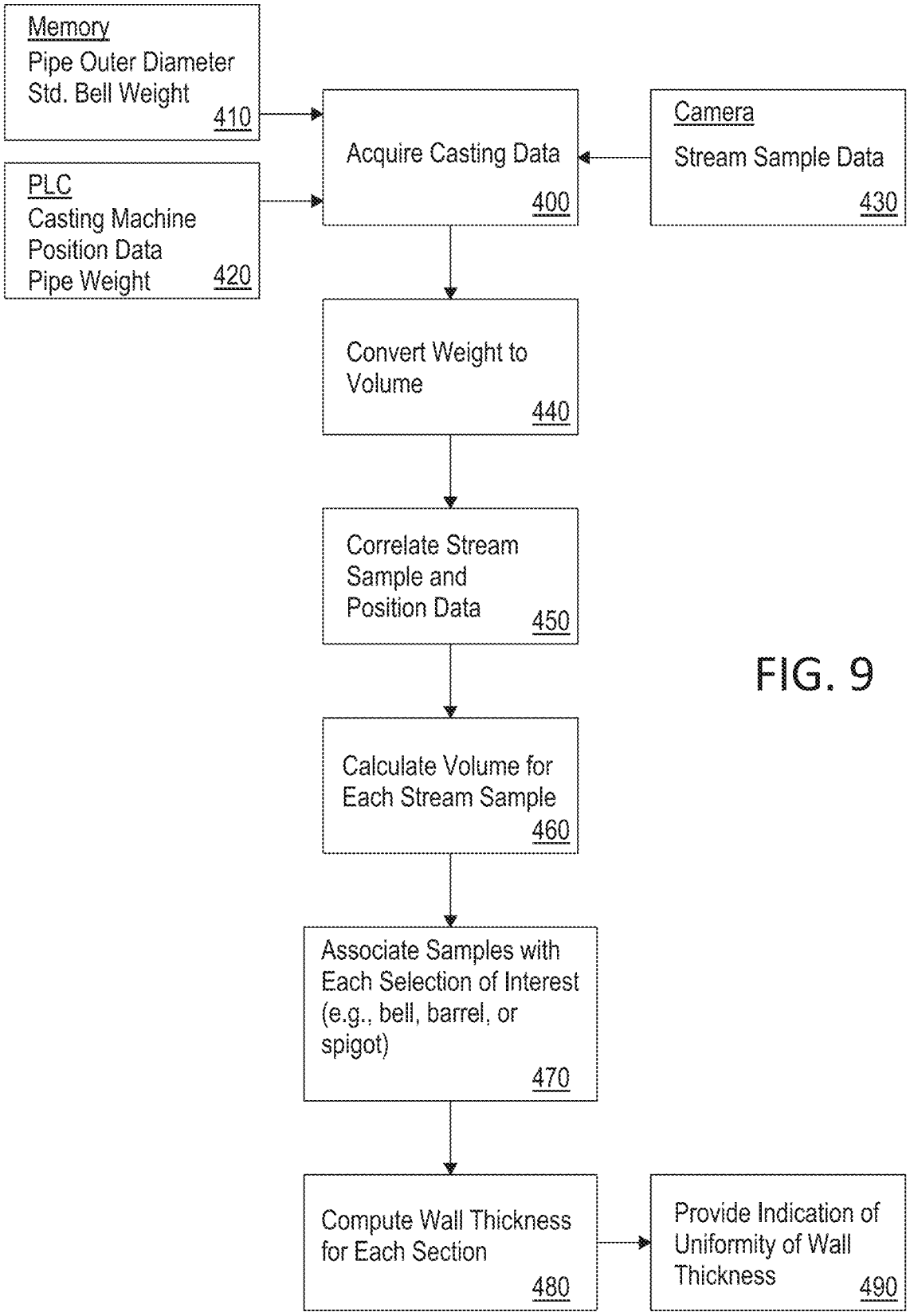
FIG. 9 is a flow chart of one embodiment of a method of the present invention.

Further steps of a preferred embodiment of the method of the present invention, to estimate the uniformity of wall thickness of a centrifugally cast object, are shown in FIG. 9. These steps are preferably programmed into software that is executed by computer 55. In step 400, the casting data is acquired. Specifically, in step 410, the outer diameter of the pipe being cast and, for an exemplary pipe having a profile shown in FIG. 2, the standard bell weight are retrieved from a memory (which may be any memory or storage medium known in the art accessible to computer 55). In step 420, casting machine position data and pipe weight are received from the PLC 50. Alternatively, in some embodiments, the scale 70 may communicate the weight directly to the computer 55 via a data link, or the weight may be entered manually into the computer 55 by an operator observing a visual readout on the scale 70. In yet other embodiments, a standard weight for the pipe is retrieved from a memory and used in the calculations described in the steps below. After an actual weight of the pipe is measured, the calculated thickness of the pipe wall is adjusted by the actual-to-standard ratio.

In step 430, data representative of the volume of the iron stream over time is received from camera 65. In a preferred embodiment, this data comprises images of the stream over time, which is processed by software in the computer 55 to return the diameter of samples of the stream upon desired or predetermined intervals, for example, ten samples per second. In other embodiments, the data may be a continuous video feed of the iron stream, which is further processed by computer 55 to determine relevant dimension(s) of the stream over time. In still further embodiments, the camera 65 processes each image and communicates data representative of any one of diameter, area, or volume of the iron stream over time.

In step 440, the weight of the pipe as measured by the scale 70 is converted to volume in accordance with the following equation:

$$V = \frac{W}{d}$$

where V is volume, W is the measured weight of object as cast, and d is the density of the material from which it is cast, in this case, molten iron (0.238 lbs/in$^3$).

Next, in step 450, the iron stream sample data is correlated with the casting machine position data. As described above, with respect to any sample of the iron stream, there is a delay from when the stream leaves the ladle (when the image is captured) to when it exits the trough. Accordingly, each sample S is associated with the longitudinal position P of the pipe where that sample was cast by correlating the sample with the position of the trough 30 (relative to the mold 20) when the sample left the trough 30 and entered the mold 20. In a preferred embodiment, casting machine position data P and iron stream image data S are sampled simultaneously on the same interval, for example, ten samples per second. Further, as noted above, a sensor records the point in time that molten iron leaves the spout 35 of the trough 30, and the point in time at which the casting machine 5 first moves, referred to as the flag, also is known and obtained from the PLC 50. The time period from the when the molten iron leaves the spout 35 of the trough 30 to when the casting machine 5 first moves is referred to as the flag delay time. The iron stream sample taken nearest the flag time and the casting machine position P at the flag time are associated with one another to align the iron stream samples with casting machine position. Stream sample data and casting machine position data after the flag, which are preferably taken on the same time interval, are associated accordingly. Stream samples taken before the flag, when the casting machine is stationary, are associated with the bell of the pipe. For example, if the flag delay time was two seconds in an exemplary process, and samples are taken every 0.1 seconds, then the first twenty samples represent the volume of iron poured between the sand core and mold to form the bell and likewise correspond to the standard bell weight.

In step 460, the volume of molten iron for each stream sample is calculated. In a preferred embodiment, the cross sectional area of the stream of each sample is determined. For example, the diameter of each stream sample may be measured or determined from the image data of the stream. The area then is calculated as follows:

$$A = \pi\left(\frac{D}{2}\right)^2$$

where A is cross sectional area of the iron stream for a sample, and D is the diameter of stream for that sample. Next, the calculated cross sectional areas for all samples are summed. The length of the iron stream is determined by dividing the pipe's volume by this sum:

$$L = \frac{V}{\sum_{S=1}^{n} A_S}$$

where L is the length of the iron stream, V is the volume of the pipe, n is the number of samples S, and A is the area for each sample S from 1 to n. The volume of molten iron for each sample can then be determined:

$$\Delta V_S = L \times A_S$$

where $\Delta V_S$ is the volume of a sample S for samples 1 to n, L is the length of the iron stream, and A is the cross sectional area of that sample.

In step 470, the samples are associated with each section of the pipe of interest so that the wall thickness of each section can be calculated. The exemplary pipe 500 as shown in FIG. 2 has three distinct sections: the bell 510, the barrel 530, and the spigot 550. With the samples having been correlated to casting machine position data (and therefore to longitudinal position P of the pipe) in step 450, the samples associated with each section are identified and segregated. For example, assume that in a set of n samples, the first x samples are associated with longitudinal positions for the bell 510, the samples from sample y to sample i are associated with longitudinal positions on the pipe 500 for the spigot 550, and then the samples in between are associated with longitudinal positions on the pipe 500 for the barrel 530, that is, from x+1 to y−1.

As described above, the trough 30 does not move relative to the mold 20 for at least part of the time that the bell 510 and spigot 550 are cast. For the barrel section 530, the trough 30 moves continuously relative to the mold 20. Using the casting machine position data, the incremental length dl that casting machine moves in time increment dt while the barrel 550 is cast is determined. Because in a preferred embodiment the stream volume data is sampled at the same interval as the position data, dt also represents the time increment associated with each stream sample.

Next, in step 480, the wall thickness of each section of the pipe is computed. The estimated wall thickness of the bell 510 of the pipe 500 is calculated in accordance with the following equation:

$$th_{bell} = \frac{OD}{2} - \left(\frac{OD^2}{4} - \left(\frac{\sum_{i=1}^{x+1} dV_i - V_{std_{bell}}}{\pi \times (P_1 - P_{x+1})}\right)\right)^{0.5} \quad (1)$$

where $th_{bell}$ is the thickness of the bell, OD is the standard outside diameter of the pipe (as controlled by the mold 20), x is the number of samples associated with the bell, $dV_i$ is volume for each sample from the first to the xth+1 sample, $V_{std_bell}$ is the standard bell volume, $P_1$ is the position of the first sample, and $P_x$ is the position of the xth sample. Because equation (1) relates to the period when the bell is filled, during which the casting machine is stationary, the position of the machine $P_{x+1}$ upon its first movement after the flag is used in equation (1) to avoid dividing by zero, and the volume corresponding to this time increment is likewise included in the volume summation.

The estimated wall thickness of the barrel 530 of the pipe 500 is calculated in accordance with the following equation:

$$th_{barrel} = \int_0^{\tau} \frac{OD}{2} - \left(\frac{OD^2}{4} - \frac{\frac{dV}{dt}}{\pi \frac{dl}{dt}}\right)^{0.5} \quad (2)$$

where $th_{barrel}$ is the thickness of the barrel, OD is the standard outside diameter of the pipe (as controlled by the mold 20), t is the time during which the barrel is cast (that is, the time period spanned by the samples associated with the barrel (that is, the samples not included in equations (1) or (3)), dV is volume of iron flow during each time increment dt, and dl is the incremental length that casting machine moves in time increment dt.

The estimated wall thickness of the spigot 550 of the pipe 500 is calculated in accordance with the following equation:

$$th_{spigot} = \frac{OD}{2} - \left(\frac{OD^2}{4} - \left(\frac{\sum_{i=y-1}^{n} dV_i}{\pi \times (P_{y-1} - P_n)}\right)\right)^{0.5} \quad (3)$$

where $th_{spigot}$ is the thickness of the spigot, OD is the standard outside diameter of the pipe (as controlled by the mold 20), n is the total number of samples (which is also the number of the last sample associated with the spigot), y is the number of the first sample associated with the spigot, dV is volume for each sample from the yth−1 to the nth sample, $P_y$ is the position of the yth sample, and $P_n$ is the position of the nth sample. Because equation (3) relates to the period when the spigot is filled, during which the casting machine is stationary, the position of the machine $P_{y-1}$ upon its last movement before the spigot check position is used in equation (3) to avoid dividing by zero, and the volume corresponding to this time increment is likewise included in the volume summation.

Figure 7:
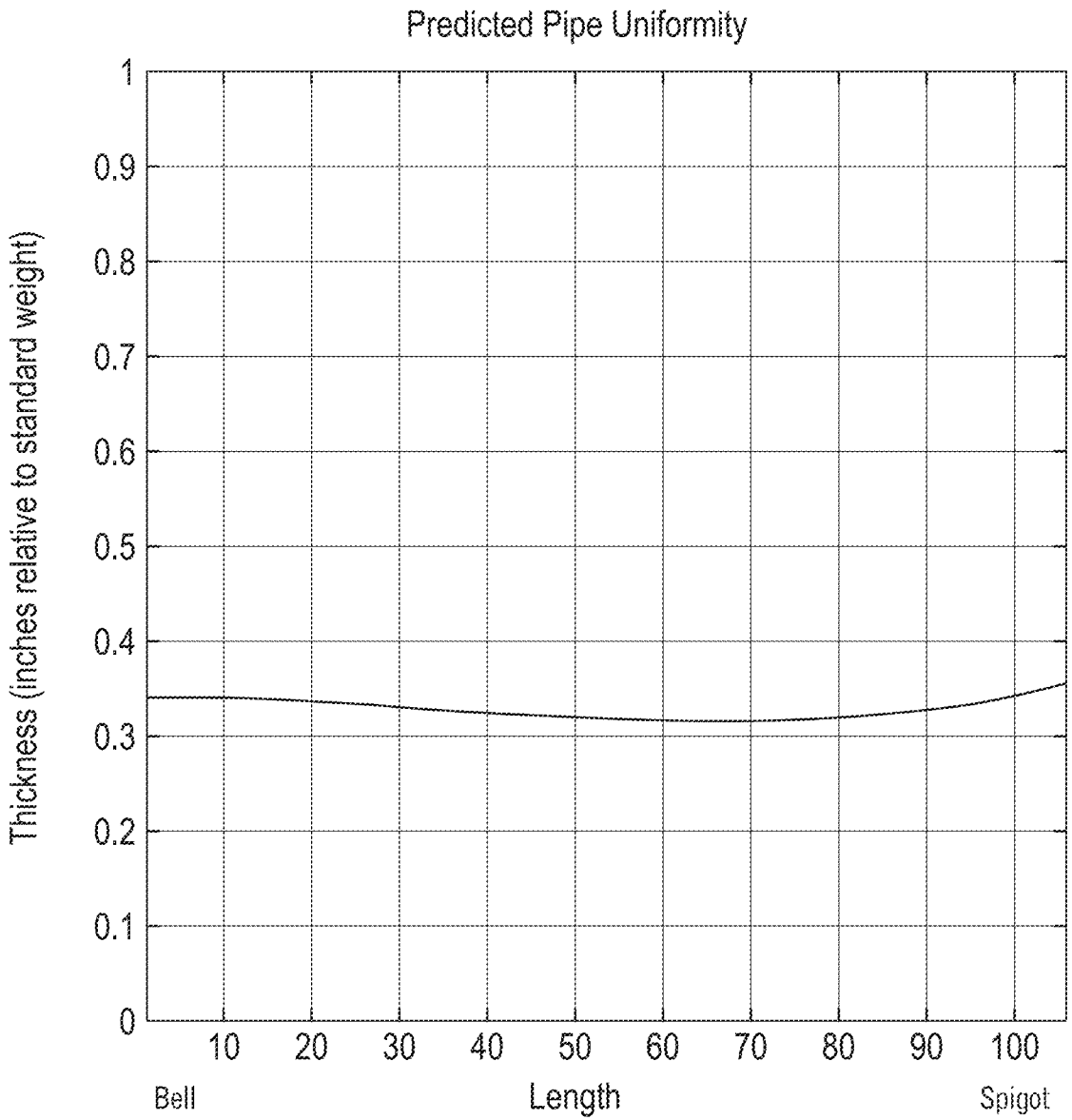
FIG. 7 is an exemplary graph plotting pipe wall uniformity according to an embodiment of a method of the present invention.

Advantageously, in step 490, data resulting from the above calculations can be used or displayed in various ways to provide feedback regarding pipe wall thickness uniformity immediately after the pipe is cast, rather than having to wait up to several hours after the cooling and annealing process when the pipe is physically measured. For example, a plot of the thicknesses calculated from equations (1), (2), and (3) provides a graphical illustration of the uniformity of the pipe wall thickness. FIG. 7 is an exemplary plot of uniformity of wall thickness. Upper and lower bounds of acceptable thickness can be added to show if and where the pipe wall does not meet specifications, and other visual indicators can alert the operator and any persons monitoring the process whether a pipe does not meet specification. Alarms can be programmed into the system itself (e.g., the software running on computer 55) with or without graphical displays of thickness when wall thickness is determined to be out of specification.

Figure 8:
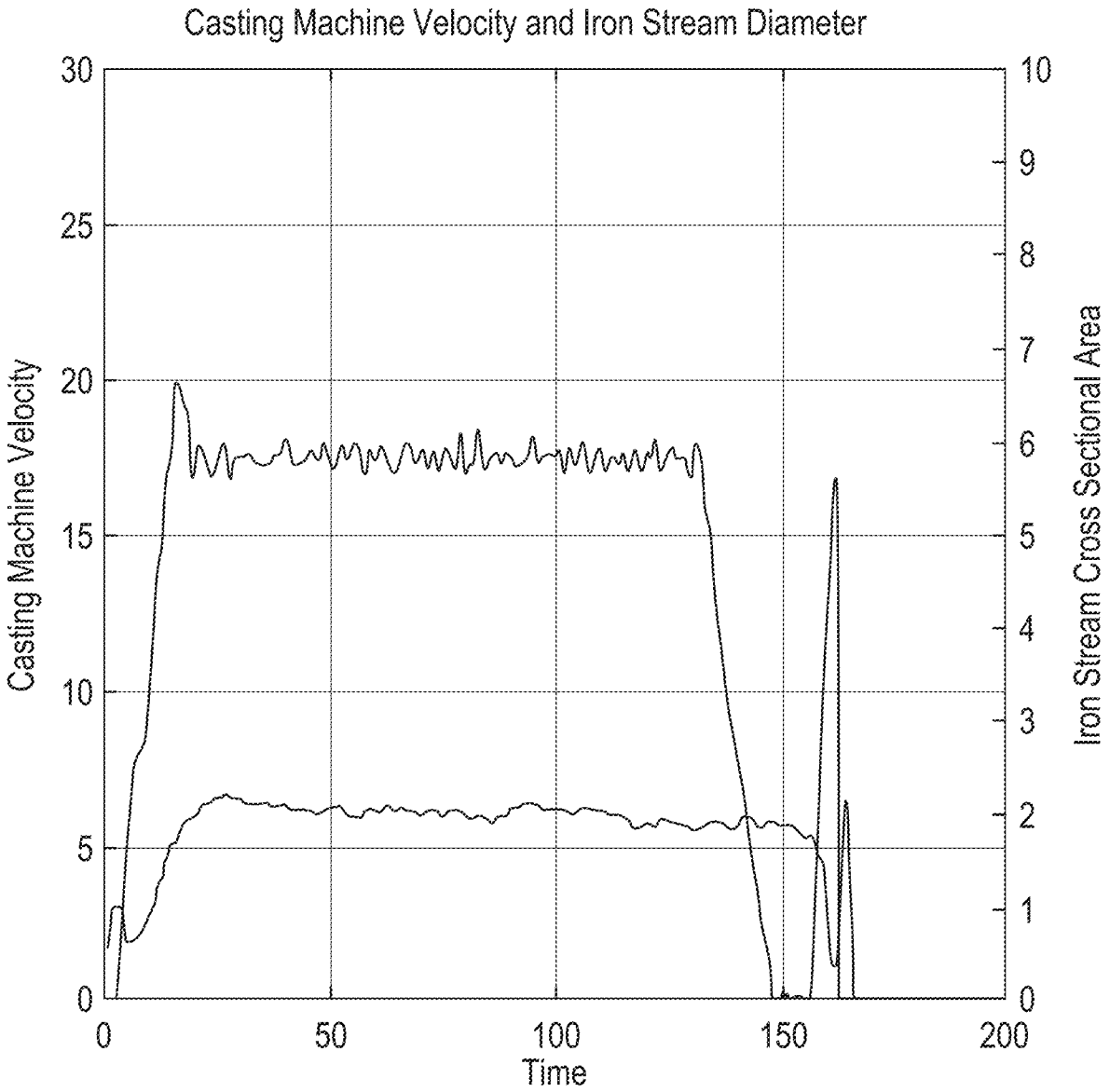

Also, variability in wall thickness can be consistently shown and predicted by plotting diameter or area of the iron stream over time and velocity of the casting machine over time, as shown in FIG. 6C or FIG. 8. When the pour curve 100 and the velocity curve 300 are aligned in time, as shown in these figures, a difference in the slopes of the pour curve 100 and velocity curve 300 during the constant velocity phase 330 indicates lack of uniformity in wall thickness of the resulting pipe as cast.

With uniformity of pipe wall thickness quantified and preferably graphically displayed at the casting stage, adjustments to controls for machine ladle pouring can be made on one or more successive casting cycles to restore uniformity. These adjustments include changing the speed of rotation of the machine ladle to adjust the pour rate and the time that the machine ladle is in its pouring position. In addition, casting machine (mold) movement, including velocity, bell acceleration, spigot deceleration, and spigot check time, also can be adjusted to restore pipe wall uniformity. For example, if the pipe wall is thinner near the beginning of the barrel, the bell acceleration curve can be adjusted accordingly. Similarly, if some non-linear modality resulting from alteration of the teapot portion of the ladle consistently caused a thickening followed by a thinning of the pipe wall over a certain length of the barrel, then the casting machine velocity could be increased and then decreased to offset the non-linearity in the pour. Whatever adjustments are made to attempt to correct the error, the estimated uniformity of pipe wall thickness provided by embodiments of the present invention provide feedback on the efficacy of the adjustment in the next casting cycle, which may be merely seconds or minutes later, rather than having to wait potentially hours after annealing and traditional measurement techniques.

In addition, examination of the pipe wall thickness data over repeated casting cycles can allow early detection of non-linearity in pouring and identification of the particular condition causing the non-linearity. This in turn can allow the non-linearity to be corrected before numerous out-of-spec pipe are cast. Analyzing aggregate data over time can reveal changes and trends in ladle conditions that ordinarily are not detectable until they are so advanced as to cause defects.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

What is claimed is:

1. A method of estimating wall thickness of an object formed in a centrifugal casting process in which molten metal is poured in a stream from a ladle into a casting machine having a trough that is movable linearly with respect to a longitudinal axis of a rotating cylindrical mold, said method comprising:

(a) measuring an area of a sample of the stream, wherein the area of the sample is measured between the ladle and the trough;

(b) determining an amount of a volume of molten metal associated with the sample using the measured area;

(c) correlating the determined volume to a longitudinal position on the mold;

(d) repeating steps (a) through (c) for a predetermined length of the mold;

(e) calculating, using determined volumes and correlated longitudinal positions, an estimated thickness of a wall of the cast object at each such position of the length.

2. The method of claim 1, wherein the determining step further comprises multiplying the area by a length of the stream associated with the predetermined length.

3. The method of claim 2, wherein the measuring step further comprises measuring a diameter of the sample.

4. The method of claim 3, wherein the diameter is measured with a machine vision device.

5. The method of claim 4, wherein the object is a pipe and the predetermined length is selected from the group consisting of a bell, a barrel, and a spigot.

6. The method of claim 2, wherein the length of the stream is determined by dividing a volume of metal associated with the predetermined length by the sum of the measured areas of each sample within the predetermined length.

7. The method of claim 6, wherein the volume associated with the predetermined length is calculated from a weight associated with the predetermined length.

8. The method of claim 7, wherein the weight is determined from the measured weight of the object after completion of the casting process.

9. The method of claim 2, wherein the correlating step comprises:

receiving position data of the casting machine;

associating the stream sample with a position of the casting machine on the longitudinal axis of the mold, wherein the association adjusts for a delay between the pouring of the determined volume and a disposition of volume into the mold from the trough.

10. The method of claim 1, wherein the correlating step comprises:

receiving position data of the casting machine;

associating the stream sample with a position of the casting machine on the longitudinal axis of the mold, wherein the association adjusts for a delay between the pouring of the determined volume and a disposition of volume into the mold from the trough.

* * * * *